United States Patent [19]

Murakado et al.

[11] 4,072,542

[45] Feb. 7, 1978

[54] ALLOY SHEET METAL FOR FINS OF HEAT EXCHANGER AND PROCESS FOR PREPARATION THEREOF

[75] Inventors: Hiroshi Murakado; Kazuhiro Nakata; Eiki Usui; Tetsuo Tamiya, all of Moka; Masahiro Chikuda, Yokohama, Japan; Yoshinobu Kitao, Shimonoseki; Akira Fujiwara, Kobe, all of Japan

[73] Assignee: Kobe Steel, Ltd., Kobe, Japan

[21] Appl. No.: 701,402

[22] Filed: June 30, 1976

[30] Foreign Application Priority Data

| | | |
|---|---|---|
| July 2, 1975 | Japan | 50-82128 |
| Sept. 8, 1975 | Japan | 50-109351 |
| Oct. 3, 1975 | Japan | 50-119933 |

[51] Int. Cl.[2] ..... C22D 1/04; C22C 21/00

[52] U.S. Cl. ..... 148/11.5 A; 148/32

[58] Field of Search ..... 148/11.5 A, 32, 32.5, 148/12.7 A

[56] References Cited

U.S. PATENT DOCUMENTS

| | | | |
|---|---|---|---|
| 3,354,531 | 11/1967 | Pryor et al. | 148/11.5 A |
| 3,938,991 | 2/1976 | Sperry et al. | 148/11.5 A |
| 3,966,506 | 6/1976 | Mandingo et al. | 148/11.5 A |
| 3,984,260 | 10/1976 | Watts et al. | 148/11.5 A |

*Primary Examiner*—W. Stallard

*Attorney, Agent, or Firm*—Oblon, Fisher, Spivak, McClelland & Maier

[57] ABSTRACT

According to the present invention, a metal sheet is prepared by subjecting an Al slab, containing at least one element capable of peritectic reaction with Al, such as Ti, Zr and Mo, the amount of the element incorporated in the slab being 0.05 to 0.4% by weight when one element is incorporated and when two or more elements are incorporated, the amount of at least one element incorporated therein being 0.05 to 0.4% by weight and the total amount of the elements incorporated being not higher than 0.5% by weight, to a soaking heat treatment, hot-rolling the slab and then cold-rolling the hot-rolled slab. According to the present invention, the properties required for such metal sheet, namely the strength and formability, can be remarkably improved, and by the hardening treatment, the adherence between fins and tubes can be improved and the heat transfer efficiency can be remarkably elevated in the heat exchangers. Thus, according to the present invention, practically applicable hard thin fins can be provided.

11 Claims, 15 Drawing Figures

ALLOY SHEET METAL FOR FINS OF HEAT EXCHANGER AND PROCESS FOR PREPARATION THEREOF

BACKGROUND OF THE INVENTION

1. Field of the Invention:

The present invention relates to an Al alloy sheet metal excellent in formability which is used for the formation of fins of a heat exchanger by forming penetrating holes for the tubes of a heat exchanger by piercing, burling, ironing, and flanging, and to a process for the preparation of such Al alloy metal sheets.

2. Description of the Prior Art:

As the conventional method for forming fins of a heat exchanger of the tube and fin type, namely a method for forming tube-penetrating holes, there can be mentioned the so-called draw-flanging method including the steps of piercing, burling and flaring as shown in FIGS. 1*a*–1*c* and a Burr oak method (Weldun method) including at least one drawing (overhanging) step, piercing, burling and flaring as shown in FIGS. 2*a*–2*f*. The Al alloy metal sheets which have generally been used for these methods are those of the pure Al series represented by A1050 (JIS Standard) and of so-called mild materials having a tensile strength $\alpha b$ of 7 to 13 Kg/mm$^2$, such as O temper material or $H_{22}$ temper material.

Recently, in order to lower the manufacturing cost, it has been desired to reduce the thickness of these fin-forming materials. However, when these soft temper materials which have heretofore been used are reduced in thickness, various problems and difficulties are brought about in connection with the forming technique and the use of the resulting fins, and they cannot be put into practical use. More specifically, handling of the same involves difficulties and defects such as cracks are readily formed during the forming step. Further, a sufficient adhesion cannot be obtained between the fins and tubes and the heat transfer efficiency is reduced.

Use of a hard material having a tensile strength $\alpha b$ of about 18 Kg/mm$^2$ has been proposed as a fin-forming material for overcoming the foregoing disadvantages, and as the fin-forming method using such hard material, there has been proposed a method comprising the steps of piercing, burling, ironing and flanging as shown in FIGS. 3*a*–3*d*.

However, when conventional Al materials are hardened and used for this fin-forming method, fine cracks are formed in the collar end portion after the ironing step and large cracks are formed during the subsequent flanging step. Accordingly, development of Al alloy metal sheets having a high strength and being excellent in formability, which can be conveniently used for the formation of fins of a heat exchanger, has been desired in the art.

SUMMARY OF THE INVENTION

The present invention has been completed as a result of our research work made with a view to overcoming the foregoing problems involved in the conventional techniques.

It is therefore a primary object of the present invention to provide an Al metal sheet having high strength and being excellent in formability, which is used for the formation of fins of a heat exchanger by forming tube-penetrating holes by piercing, burling, ironing and flanging, and a process for the preparation of this Al alloy metal sheet.

A secondary object of the present invention is to provide an Al alloy metal sheet applicable to the formation of hard thin fins and a process for the preparation of this Al alloy sheet metal.

A third object of the present invention is to provide an Al alloy metal sheet capable of improving the adherence between a fin and a tube, and a process for the preparation of this Al alloy metal sheet.

In accordance with the first aspect of the present invention for attaining the foregoing objects, there is provided a process for preparing an Al alloy metal sheet for the fins of a heat exchanger, which comprises subjecting an Al slab, containing at least one element selected from Ti, Zr, Mo, Cr, V, Hf, Ta, W, Nb, Tc and Re, and preferably Ti, Zr and Mo, the amount of the element incorporated in the slab being 0.05 to 0.4% by weight, and preferably 0.1 to 0.2% by weight, when one element is incorporated and when two or more elements are incorporated, the amount of at least one element incorporated therein being 0.05 to 0.4% by weight and the total amount of the incorporated elements being not higher than 0.5% by weight, to a soaking heat treatment at a temperature of 350 to 630° C. for 1 to 48 hours, hot-rolling the slab and cold-rolling the hot-rolled slab at a reduction ratio of at least 20%, and preferably at least 70%.

In accordance with the second aspect of the present invention, there is provided a process as set forth in the first aspect, wherein the Al slab further contains at least one member selected from the group consisting of up to 0.25% by weight of Cu, up to 0.5% by weight of Mg, up to 0.5% by weight of Mn, up to 0.7% by weight of Fe, up to 0.002% by weight of Be, up to 0.1% by weight of B in the form of $TiB_2$ and up to 0.7% by weight of Si.

In accordance with the third aspect of the present invention, there is provided a process as set forth in the first aspect, wherein the Al slab further contains 0.5 to 2.0% by weight of Zn.

In accordance with the fourth aspect of the present invention, there is provided a process as set forth in the first, second or third aspect, wherein the Al slab is subjected to an intermediate annealing after the hot-rolling or during the cold-rolling under heating conditions not initiating recrystallization.

In accordance with the fifth aspect of the present invention, there is provided a process as set forth in the first, second, third or fourth aspect, wherein after the cold-rolling, the cold-rolled slab is subjected to a tempering annealing at a coil temperature of at least 150° C. for 1 to 6 hours.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein.

DETAILED DESCRIPTION OF THE ILLUSTRATED EMBODIMENTS

Figure 1A:
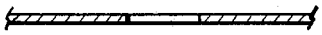
FIGS. 1*a*–1*c* illustrate a drawing and flanging process for preparing the fins of a heat exchanger.
Figure 1B:
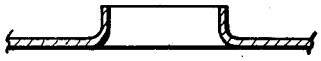
Figure 1C:
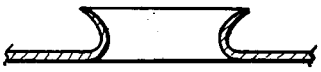
Figure 2A:
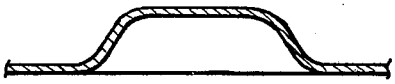
FIGS. 2*a*–2*f* illustrate a similar Burr oak process (Weldun process)
Figure 2B:
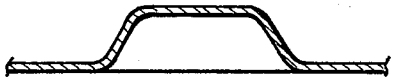
Figure 2C:
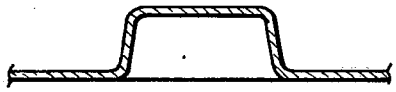
Figure 2D:
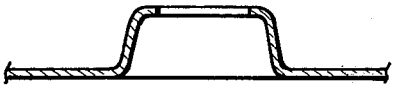
Figure 2E:
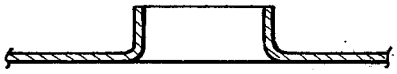
Figure 2F:
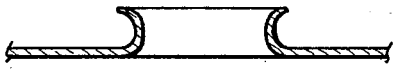
Figure 3A:
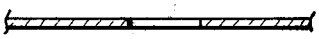
FIGS. 3*a*–3*d* illustrate a process in which ironing is carried out after burling.
Figure 3B:
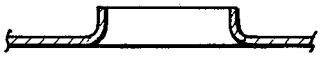
Figure 3C:
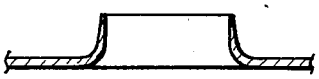
Figure 3D:
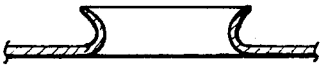

With a view to overcoming the above-mentioned defects involved in conventional Al alloy metal sheets, we have performed research work on both the Al alloy composition and the steps of forming Al slabs into metal sheets. As a result, we have succeeded in developing an Al alloy having such a high tensile strength as capable of fully meeting the requirement of thickness reduction in heat exchanger fin-forming materials and showing a very excellent formability when it is applied to a process for the preparation of fins of heat exchangers which comprises the steps of piercing, burling, ironing and flanging.

The present invention will now be described in detail.

In practicing the process of the present invention, an Al slab is first prepared under the following conditions. More specifically, at least one member selected from elements capable of peritectic reaction with Al, such as Ti, Zr, Mo, Cr, V, Hf, Ta, W, Nb, Tc and Re, is incorporated and dissolved in Al as the indispensable component, and the melt is cast according to a known method, for example, a semi-continuous casting method. When one element is incorporated, the amount of the incorporated element if preferably 0.05 to 0.40% by weight, and when two or more elements are simultaneously incorporated, the amount of at least one incorporated element is preferably 0.05 to 0.4% by weight and the total amount of these additive elements is preferably not higher than 0.5% by weight.

Reasons for the limitation of the amount incorporated of such indispensable additive elements are as follows.

When one element is incorporated, if the amount incorporated is lower than 0.05% by weight, no substantial element of improving the formability can be attained. When the amount incorporated of the element is higher than 0.40% by weight in case of incorporation of one element or when the total amount is higher than 0.50% by weight in case of incorporation of two or more elements, no substantial effect of improving the formability can be attained, and further, the casting property is degraded and macro-compounds are readily formed, resulting in various defects. In view of the degree of improvement of the formability and from the economical viewpoint, Ti, Zr and Mo are most preferred among the foregoing elements capable of peritectic reaction with Al, and in case of these preferred elements, it is preferred that the amount incorporated be 0.1 to 0.2% by weight.

Preferred additive elements and impurities which are incorporated in addition to the foregoing indispensable elements will now be described.

Cu, Mg and Mn are effective for increasing the strength. Accordingly, it is recommended to incorporate at least one of these elements.

The amounts incorporated of these elements and reasons for the limitation of these amounts will now be described.

The amount incorporated of Cu is up to 0.25% by weight. If the amount of Cu is up to 0.25% by weight, an effect of improving the strength can be attained, but if the amount is in excess of 0.25% by weight, the corrosion resistance is reduced.

Mg is incorporated in an amount of up to 0.5% by weight. When the amount is up to 0.5% by weight, the strength is improved, but if the amount is higher than 0.5% by weight, the effect attained by the indispensable element is reduced.

Mn is incorporated in an amount of up to 0.5% by weight. If the amount is up to 0.5% by weight, the strength is improved, but if the amount exceeds 0.5% by weight, the effect attained by the indispensable element is reduced.

Fe has an effect of preventing scarring when ironing is carried out in the fin-forming process or the like. Accordingly, if forming is conducted under such severe conditions, it is preferred to incorporate Fe. If Fe is incorporated, the amount incorporated of Fe is preferably up to 0.7% by weight. When Fe is incorporated in an amount of up to 0.7%, scarring is prevented to improve the formability and an effect of making the crystal grains finer can be attained. However, if Fe is incorporated in an amount larger than 0.7% by weight, the corrosion resistance is reduced and the effect attained by the indispensable element is also reduced.

Be has an effect of preventing oxidation of the melt, and when the melt contains Mg or the like, it is especially preferred to incorporate Be. Be is incorporated in an amount of up to 0.002% by weight and in this case, an oxidation-preventing effect can be attained. However, if the amount of Be exceeds 0.002% by weight, a problem of toxicity is brought about at the melting step.

B has an effect of making the cast structure finer when it is incorporated in the form of $TiB_2$. It is therefore recommended to incorporate $TiB_2$ according to need. The amount incorporated of B is up to 0.1% by weight (as $TiB_2$) and in this case, the effect of making crystal grains finer can be obtained. However, if B is incorporated in an amount larger than 0.1% by weight, no substantial effect can be attained but large compounds are readily formed.

Si and other rare earth elements are regarded as impurities in the present invention, and they may be present in the slab within the range where the intended objects of the present invention can be attained. However, they need not be positively incorporated. Allowable contents of these impurities will now be described.

Si may be contained in such an amount as is usually contained in alloys. More specifically, Si may be contained in an amount of up to 0.7% by weight. If the amount of Si exceeds 0.7% by weight, the effect attained by the indispensable element is reduced.

In case of a heat exchanger composed wholely of aluminum, it is important to prevent corrosion of the aluminum tubes, and corrosion of the tubes proper is prevented by causing corrosion preferentially in the fins. For this purpose, Zn is incorporated in an amount of 0.5 to 2.0% by weight. If the amount of Zn is smaller than 0.5% by weight, the electrode potential cannot be made sufficiently negative, and if the amount of Zn is larger than 2.0% by weight, the corrosion takes place too quickly in the fins. In case of an ordinary heat exchanger composed of copper, the amount of Zn is maintained below 0.25% by weight in view of the corrosion resistance.

A slab prepared from the melt having the above composition is then subjected to a soaking heat treatment. The temperature and time conditions for the soaking treatment are varied to some extent depending on the slab size and other factors. In general, the soaking heat treatment is carried out at 350° to 630° C. for 1 to 48 hours.

The slab is then subjected to hot-rolling. Hot-rolling conditions are decided according to the rolling program determined in relation to the subsequent cold-rolling. In general, the hot-rolling is carried out under such conditions that the rolled thickness is 2 to 25 mm and the temperature at the termination of the hot-rolling is 250° to 500° C.

The hot-rolled slab is then cold-rolled. The reduction ratio attained at the cold-rolling step is very important in the present invention. Namely, it is necessary that the reduction ratio should be at least 20%. If the reduction ratio at the cold-rolling step is lower than 20%, desirable strength and formability cannot be obtained and it is preferred that the reduction ratio attained at the cold-rolling step be at least 70%. Under these conditions, hard materials such as $H_{19}$ can be obtained.

According to the rolling program, intermediate cold-rolling may be carried out between the above-mentioned hot-rolling and cold-rolling steps. Further, annealing may be performed before or after the cold-rolling step according to a conventional method. Whether or not such intermediate cold-rolling or intermediate annealing is carried out, it is indispensable in the present invention that the reduction ratio attained at the cold-rolling step should be at least 20%.

A sufficient formability can be obtained only by performing the foregoing soaking heat treatment, hot-rolling and cold-rolling. In order to obtain a further improved formability, it is preferred that intermediate annealing be carried out between the hot-rolling and cold-rolling steps or during the cold-rolling step.

In the case where annealing is performed according to a batch type method using an annealing coil, the annealing is carried out at a temperature lower than 400° C. When annealing is performed by quick heating according to, for example, a continuous annealing method, a higher temperature of 400° to 600° C. can be adopted. In case of the batch type method, since the heating rate is low, if annealing is carried out at a temperature higher than 400° C., crystal grains are coarsened and coarse crystal grains have an adverse influence on the formability. In case of the continuous method, such disadvantage is not brought about. In short, annealing conditions are varied according to the annealing method adopted, and in any method, it is necessary that the annealing should be conducted at a temperature which will not cause recrystallization.

The cold-rolled material prepared under the foregoing conditions corresponds to $H_{19}$ material; namely, it has a tensile strength $\alpha b$ of about 18 Kg/mm$^2$, and a hard metal sheet capable of fully meeting the objects of the present invention, that is, hard metal sheet having a high strength and an excellent formability, can be prepared according to the above-mentioned process of the present invention.

The so prepared metal sheet is excellent in formability and has high strength, and it can be put into practical use as it is. However, if a higher formability is required, it is preferred to conduct the tempering annealing under relatively low temperature conditions, more specifically, at a temperature of at least 150° C. for 1 to 6 hours.

It is very interesting that the gradient of the softening characteristic curve of the alloy of the present invention is very gradual and this tendency is especially conspicuous in the low temperature region. Therefore, if the tempering annealing is carried out under the above-mentioned low temperature conditions, the formability can be improved while the strength is hardly reduced.

The reason why the lower limit of the annealing temperature is specified as 150° C. in the present invention is that if the annealing is carried out at a temperature lower than 150° C., the formability is not improved over the formability of the cold-rolled material described above.

As will be apparent from the foregoing illustration, the cold-rolled material prepared according to the present invention and a material prepared by subjecting this cold-rolled material to the low tmeperature tempering annealing have very excellent characteristics which are not observed at all in conventional materials.

For a better illustration of the present invention, examples of the present invention will now be described together with experimental data.

EXAMPLE 1

An aluminum alloy ingot was prepared according to a semi-continuous casting method, and the surface was cut and flattened to obtain a slab having a thickness of 40 mm. The chemical composition of this sample was as shown in Table 1.

Table 1

| Sample No. | Chemical Composition of Sample Tested | | | | | | | | |
|---|---|---|---|---|---|---|---|---|---|
| | Cu | Si | Fe | Mn | Mg | Zn | Cr | Ti | Al |
| 1 | 0.007 | 0.05 | 0.29 | 0.008 | 0.010 | 0.002 | trace | 0.015 | balance |
| 2 | 0.001 | 0.05 | 0.15 | 0.001 | 0.004 | 0.006 | trace | 0.170 | balance |

Sample No. 1 is a conventional material, 1050 alloy, and sample No. 2 is an alloy of the present invention including Ti.

Each of these samples was subjected to the soaking heat treatment at 540° C. for 6 hours and hot-rolled to reduce the thickness to 5 mm. While this thickness was maintained, the intermediate annealing was conducted at 360° C. for 1 hour, and the sample was cooled and cold-rolled to obtain a metal sheet having a thickness of 0.15 mm. In connection with sample No. 2, a metal sheet was similarly prepared without performing the intermediate annealing. [sample No. 2(A)].

Sample 2(B) was an as-cold rolled product, but samples 1, 2(A) and 2(C) were products obtained by conducting the tempering annealing at 100° to 400° C. for 2 hours after cold-rolling.

These samples were subjected to the burling operation, which is one of the important operations of the process for preparing the fins of a heat exchanger. Results are shown in Table 2. The burling ratio referred to in Table 2 is a value calculated according to the following formula:

$$\frac{D-d}{d} \times 100$$

wherein d denotes the diameter of the first pierced hole and D denotes the diameter of a burling punch.

Accordingly, a material having a higher critical burling ratio causing breakage has a better formability.

Table 2

| Sample No. | Intermediate Annealing | Tempering | Burling Test Results: Burling Ratio (%) 39 | 43 | 47 | 52 | 56 | 61 | 67 | 72 |
|---|---|---|---|---|---|---|---|---|---|---|
| 1 | effected | H29 | ΔΔo | ΔΔΔ | ΔXX | XXX | XXX | XXX | XXX | XXX |
| 2(A) | not effected | H29 | ooo | ooo | ΔoΔ | XΔΔ | XXX | XXX | XXX | XXX |
| 2(B) | effected | H19 | ooo | ooo | ooo | oXo | oXX | XXX | XXX | XXX |
| 2(C) | effected | H29 | ooo | ooo | ooo | ooo | ooΔ | ΔXX | XXX | XXX |

Notes
o: no cracks
Δ: vena contracta (state just before cracking)
X: cracks
H29 & H19: H29 means a product obtained by annealing H19 (as-cold-rolled product) at low temperatures and it has a strength comparable to that of H19.

As will be apparent from the results shown in Table 2, in the alloy No. 2 of the present invention, by incorporation of Ti, the formability is improved over the conventional alloy 1050, and this improvement is enhanced by the intermediate annealing.

The tempered material No. 2(C) has a strength comparable to that of the non-tempered material No. 2(B) but is excellent over the material No. 2(B) with respect to formability.

EXAMPLE 2

An aluminum alloy slab was prepared according to a semi-continuous casting method, and the surface was cut and flattened to obtain a slab having a thickness of 40 mm. The chemical composition of the so prepared sample was as shown in Table 3. The sample shown in this Table is an alloy of the present invention including Mo.

Table 3

| Chemical Composition of Sample: Cu | Si | Fe | Mn | Mg | Zn | Cr | Ti | Mo | Al |
|---|---|---|---|---|---|---|---|---|---|
| 0.002 | 0.05 | 0.16 | 0.002 | 0.003 | 0.006 | trace | 0.029 | 0.10 | balance |

The sample was subjected to the soaking treatment at 540° C. for 6 hours and then hot-rolled to reduce the thickness to 5 mm. While this thickness was maintained, the intermediate annealing was carried out at 360° C. for 1 hour. Then, the sample was cooled and cold-rolled to obtain a metal sheet having a thickness of 0.15 mm.

The so obtained material was subjected to the burling test to obtain the results shown in Table 4.

Table 4

| Tempering | Burling Test Results: Burling Ratio (%) 39 | 43 | 47 | 52 | 56 | 61 | 67 | 72 |
|---|---|---|---|---|---|---|---|---|
| H29 | ooo | ooo | ooo | ooo | Δoo | X X | XXX | XXX |

As will be apparent from the test results shown in Table 4, the alloy of the present invention including a suitable amount of Mo can be worked without cracking at a burling ratio of up to 56% and hence, it is very excellent in formability.

EXAMPLE 3

An aluminun alloy slab was prepared according to a semi-continuous casting method, and the surface was cut and flattened to obtain a slab having a thickness of 500 mm. The chemical composition of the sample was as shown in Table 5.

Table 5

| Sample No. | Chemical Composition of Sample: Cu | Si | Fe | Mn | Mg | Zn | Cr | Ti | Zr | Al |
|---|---|---|---|---|---|---|---|---|---|---|
| 3 | 0.008 | 0.10 | 0.30 | 0.010 | 0.027 | 0.002 | — | 0.020 | — | balance |
| 4 | 0.017 | 0.08 | 0.30 | 0.008 | 0.010 | 0.001 | trace | 0.015 | 0.04 | balance |
| 5 | 0.017 | 0.08 | 0.29 | 0.008 | 0.002 | 0.001 | trace | 0.018 | 0.20 | balance |

Sample No. 3 is a conventional material, 1050 alloy, sample No. 4 is a comparative material containing Zr in an amount outside the range specified in the present invention, and sample No. 5 is an alloy of the present invention containing 0.2% by weight of Zr.

Each sample was subjected to the soaking heat treatment of 540° C. for 3 hours and hot-rolled to reduce the thickness to 3.5 mm.

While this thickness was maintained, the intermediate annealing was carried out at 350° C. for 2 hours. In case of samples Nos. 4 and 5, materials which had not been subjected to the intermediate annealing were also prepared.

Each sample was cold-rolled to obtain a sheet metal having a thickness of 0.15 mm. With respect to each cold-rolled sample, the heat treatment was conducted at a temperature varying in the range of 150° to 500° C. for 2 hours.

These samples were subjected to the burling operation, which is one of the important operations in the process for forming metal sheets for the fins of a heat exchanger or the like. Results are shown in Table 6.

Table 6

| Sample No. | Intermediate Annealing | Tempering | Formability Test Results: Burling Ratio (%) 39 | 43 | 47 | 52 | 56 | 61 | 67 | 72 |
|---|---|---|---|---|---|---|---|---|---|---|
| 3 | effected | H29 | ooo | ooo | XΔX | XXX | XXX | XXX | XXX | XXX |
| 4 | not effected | H29 | ooo | ooo | ΔΔX | XXX | XXX | XXX | XXX | XXX |
| 4 | effected | H29 | ooo | ooΔ | XXX | XXX | XXX | XXX | XXX | XXX |
| 5 | not effected | H29 | ooo | ooo | ooo | ooo | XoX | XXX | XXX | XXX |
| 5 | effected | H29 | ooo | ooo | ooo | ooo | ooo | ooΔ | ΔXX | XXX |

As will be apparent from the results shown in Table 6, alloy No. 5 of the present invention is excellent over the conventional alloy 1050 with respect to formability. This excellent formability is further enhanced by intermediate annealing.

As will be apparent from the results obtained with respect to alloy No. 4, the intended effect cannot be attained when Zr is incorporated in such a small amount as 0.04%.

EXAMPLE 4

An aluminum ingot was prepared according to a semi-continuous casting method, and the surface was cut and flattened to obtain a slab having a thickness of 40 mm. The chemical composition of the sample was as shown in Table 7.

This sample was an alloy of the present invention comprising primarily Cr, Ti and Zr.

Table 7

| Chemical Composition of Sample | | | | | | | | | |
|---|---|---|---|---|---|---|---|---|---|
| Cu | Si | Fe | Mn | Mg | Zn | Cr | Ti | Zr | Al |
| 0.003 | 0.06 | 0.15 | 0.002 | 0.004 | 0.005 | 0.11 | 0.15 | 0.13 | balance |

The results of the burling test made on this alloy were as shown in Table 8.

Table 8

| Burling Test Results | | | | | | | | |
|---|---|---|---|---|---|---|---|---|
| Temp- | Burling Ratio (%) | | | | | | | |
| ering | 39 | 43 | 47 | 52 | 56 | 61 | 67 | 72 |
| H29 | ooo | ooo | ooo | XXo | oXX | XXX | XXX | XXX |

COMPARATIVE EXAMPLE 1

In this example, it is illustrated that incorporation of elements capable of eutectic reaction with Al has no effect of improving the formability.

Materials to be tested were prepared in the same manner as in Example 1 except that the thickness after the hot-rolling was 3 mm, and all of the samples to be tested were subjected to the intermediate annealing. The chemical composition was as shown in Table 9.

Table 9

| Sample No. | Chemical Composition of Sample | | | | |
|---|---|---|---|---|---|
| | Cu | SI | Fe | Mn | Mg |
| 7 | 0.08 | 0.08 | 0.54 | 0.004 | 0.003 |
| 8 | 0.16 | 0.14 | 0.59 | 1.32 | 0.009 |
| * | | | | | |
| Sample No. | Zn | Cr | Ti | Al | |
| 7 | trace | trace | 0.035 | balance | |
| 8 | 0.076 | 0.002 | 0.038 | balance | |

Sample No. 7 was formed by adding Fe to the conventional alloy 1050, and sample NO. 8 was formed by adding Fe and Mn to the alloy 1050. Results of the burling test are shown in Table 10.

Table 10

| Burling Test Results | | | | | | | | | |
|---|---|---|---|---|---|---|---|---|---|
| Sample No. | Tempering | Burling Ratio | | | | | | | |
| | | 39 | 43 | 47 | 52 | 56 | 61 | 67 | 72 |
| 7 | H29 | ooo | ΔoΔ | oXX | XXX | XXX | XXX | XXX | XXX |
| 8 | H26 | ΔoΔ | XoX | XXX | XXX | XXX | XXX | XXX | XXX |

In order to uniformalize the strength level, sample No. 8 was tempered to H26. If the strength was elevated to a level of H29, the test results were further worsened.

As will be apparent from the results shown in Table 10, in alloys of this Comparative Example, the formability is not improved at all over that of the alloy 1050 shown in Example 1.

EXAMPLE 5

Metal sheets of the conventional alloys 1050 and the alloys of the present invention, prepared in Examples 1 to 4 and having a thickness of 0.15 mm, were further cold-rolled until the thickness was reduced to 0.11 mm. These materials were formed into fins of a heat exchanger having a hole diameter of 9.8 mm according to the forming process including the ironing step.

Figure 4:
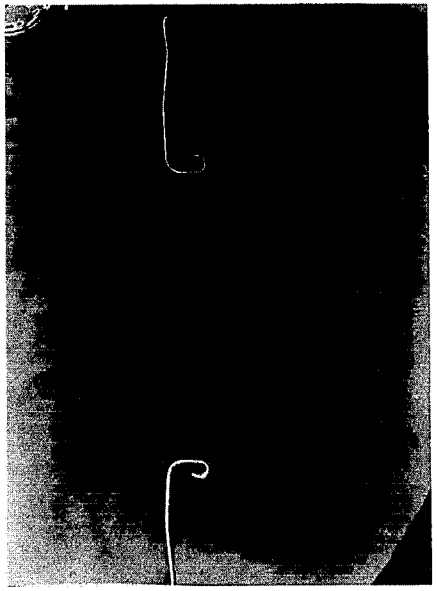
FIGS. 4 and 5 are microscopic photographs showing section of fins obtained according to the process of the present invention.
Figure 5:
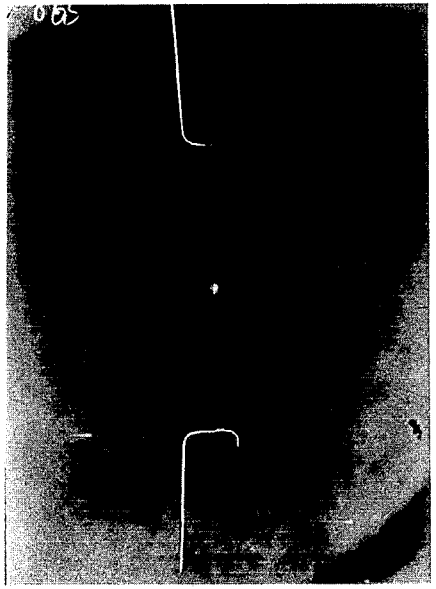

In the case of the alloy 1050, cracks were formed in the flare portion and fins applicable to practical use could not be obtained. Each of the alloys of the present invention was formed into fins without cracking. Sections of fins prepared from the alloys of the present invention are shown in microscopic photographs of FIGS. 4 and 5.

EXAMPLE 6

An aluminum slab was prepared according to a semi-continuous casting method, and the surface was cut and flattened to obtain a slab having a thickness of 40 mm. The chemical composition of the sample was as shown in Table 11.

Table 11

| Sample No. | Chemical Composition of Sample | | | | | | | | | |
|---|---|---|---|---|---|---|---|---|---|---|
| | Cu | Si | Fe | Mn | Mg | Zn | Cr | Ti | Zr | Al |
| 1 | 0.007 | 0.05 | 0.29 | 0.008 | 0.010 | 0.002 | trace | 0.015 | — | balance |
| 2 | 0.002 | 0.040 | 0.15 | 0.005 | 0.002 | 1.05 | trace | 0.031 | — | balance |
| 3(A) | 0.002 | 0.036 | 0.14 | 0.004 | 0.002 | 1.02 | trace | 0.028 | 0.06 | balance |
| 3(B) | 0.004 | 0.040 | 0.16 | 0.002 | 0.007 | 1.05 | trace | 0.032 | 0.11 | balance |
| 3(C) | 0.003 | 0.05 | 0.15 | 0.003 | 0.005 | 1.06 | 0.003 | 0.16 | — | balance |
| 3(D) | 0.008 | 0.04 | 0.17 | 0.007 | 0.006 | 1.09 | 0.15 | 0.14 | 0.17 | balance |

Samples Nos. 1 and 2 are convenient alloys 1050 and 7072, respectively. Sample Nos. 3(A) to 3(D) are alloys of the present invention containing a prescribed amount of at least one element of Zr, Ti and Cr capable of peritectic reaction with Al and further containing about 1% of Zn.

Each sample was subjected to the soaking heat treatment at 450° C. for 6 hours and hot-rolled to reduce the thickness to 5 mm.

Then, while this thickness was maintained, the intermediate annealing was carried out at 360° C. for 1 hour. The sample was then cooled and cold-rolled to obtain a metal sheet having a thickness of 0.15 mm.

In the case of samples Nos. 2 and 3, metal sheets were similarly prepared without conducting the intermediate annealing. As-cold-rolled materials and materials formed by heat-treating the as-cold-rolled materials at temperatures varying within a range of 150° to 400° C. for 2 hours were used as materials to be tested.

Electrode potentials of these alloys were measured to obtain the results shown in Table 12.

Table 12

| Sample No. | Electrode Potential (VS.S.C.E.)* |
|---|---|
| 1 | −750 (mv) |
| 2 | −890 (mv) |
| 3(A) to (D) | −890 (mv) |

*3% NaCl, in the open air

As will be apparent from the results shown in Table 12, the alloys Nos. 3(A) to 3(D) of the present invention have a potential equivalent to that of the conventional alloy No. 2 but the potential is much lower than that of the pure aluminum type alloy (alloy 1050). Thus, it is seen that the alloys of the present invention have sacrificing anode characteristics.

These materials were subjected to the burling operation, which is one of important operations of the process for forming sheet metals for fins of a heat exchanger. Results are shown in Table 13.

Table 13

| Sample No. | Intermediate Annealing | Tempering | Burling Test Results: Burling Ratio (%) 39 | 43 | 47 | 52 | 56 | 61 | 67 | 72 |
|---|---|---|---|---|---|---|---|---|---|---|
| 1 | effected | H29 | ΔΔo | ΔΔΔ | ΔXX | XXX | XXX | XXX | XXX | XXX |
| 2 | effected | H29 | ooo | oΔΔ | XXX | XXX | XXX | XXX | XXX | XXX |
| 3(A) | not effected | H29 | ooo | ooo | ΔΔΔ | XXX | XXX | XXX | XXX | XXX |
| 3(A) | effected | H19 | ooo | ooo | ΔXΔ | XXX | XXX | XXX | XXX | XXX |
| 3(A) | effected | H29 | ooo | ooo | ooo | ΔoΔ | ΔΔX | XXX | XXX | XXX |
| 3(B) | not effected | H29 | ooo | ooo | oΔo | XXΔ | XXX | XXX | XXX | XXX |
| 3(B) | effected | H19 | ooo | ooo | ΔΔΔ | xΔX | XXX | XXX | XXX | XXX |
| 3(B) | effected | H29 | ooo | ooo | ooo | Δoo | ΔΔΔ | ΔXX | XXX | XXX |
| 3(C) | effected | H29 | ooo | ooo | ooo | oΔo | oΔΔ | XXX | XXX | XXX |
| 3(D) | effected | H29 | ooo | ooo | ooo | ΔΔo | XΔΔ | XXX | XXX | XXX |

As will be apparent from the results shown in Table 13, the alloys Nos. 3(A) to 3(D) of the present invention containing at least one of elements capable of peritectic reaction with Al have a highly improved formability over the conventional alloy 7072 (No. 2), and this improvement is enhanced by the intermediate annealing.

As pointed out hereinbefore, when Al metal sheets are used for fins of a heat exchanger composed wholly of aluminum, in order to protect the heat exchanger tube from corrosion, the fins must be corroded preferentially. For this purpose, it is preferred that the electrode potential of the fin-forming material be negative, namely the materials be excellent in sacrificing anode characteristics. As will be apparent from the results obtained in Example 6, the alloy materials Nos. 3(A) to 3(D) of the present invention are far superior than the conventional alloy 1050 material. The conventional alloy 7072 material (sample No. 2) is comparable to the alloy materials of the present invention with respect to the sacrificing anode characteristics, but as will be apparent from the results shown in Table 13, this conventional alloy is very inferior in formability.

In the present invention, the sacrificing anode characteristics are improved by incorporating Zn at a relatively high level, such as, 0.5 to 2.0% by weight. This composition is adopted only when the alloy of the present invention is used for fins of a heat exchanger composed of aluminum alone. If the alloy of the present invention is used for fins of a heat exchanger composed of copper or the like, it is preferred that the Zn content be reduced to a lower lever, namely below 0.25% by weight.

As will be apparent from the foregoing illustration, when the aluminum alloy of the present invention is employed, hard thin fins can be practically provided. Further, even when the alloy of the present invention is applied to the fin-forming process including the piercing, burling, ironing and flanging steps, since the alloy has an excellent formability and has a higher strength than the conventional materials, the alloy of the present invention can be conveniently formed, and since the resulting fins are hard, the adhesion between the fins and tubes can be remarkably enhanced and the heat transfer efficiency of the heat exchanger can be remarkably enhanced.

Since the aluminum alloy of the present invention is excellent in both strength and formability, it is expected that it will be used for materials or articles formed by drawing, expanding, piercing, ironing, bending and flanging or by combinations of these steps, in addition to fins of a heat exchanger, and that novel uses will be developed for the aluminum alloy of the present invention.

Obviously, many modifications and variations of the present invention are possible in light of the above teachings. It is to be understood therefore that within the scope of the appended claims, the present invention may be practiced otherwise than as specifically described herein.

What is claimed as new and desired to be securd by letters patent of the United States is:

1. A process for the preparation of metal sheets for use in the formation of fins of heat exchangers having tube-penetrating holes formed therein by piercing, burling, ironing and flanging steps, which comprises the steps of:

subjecting an Al slab, comprising at least one member from Ti, Zr, Mo, Cr, V, Hf, Ta, W, Nb, Tc and Re capable of peritectic reaction with Al, the amount of said element incorporated within said slab being 0.05 to 0.4% be weight when one element is incorporated therein, and when two or more elements are incorporated therein, the amount of at least one element incorporated therein is 0.05 to 0.4% by weihgt, and the total amount of said elements being incorporated therein is up to 0.5% by weight, and the Al slab further comprises at least one member selected from the group consisting of up to 0.25% by weight of Cu, up to 0.5% by weight of Mg, up to 0.5% by weight of Mn, up to 0.7% by weight of Fe, up to 0.002% by weight of Be, up to 0.1% by weight of B in the form of $TiB_2$ and up to 0.7% by weight of Si, to a soaking treatment, hot-rolling said slab, and cold-rolling said hot-rolled slab.

2. A metal sheet as set forth in claim 1, wherein: said Al slab is subjected to an intermediate annealing, at a temperature not initiating recrystallization, after said hot-rolling or during said cold-rolling.

3. A metal sheet as set forth in claim 1, wherein: said Al slab is subjected to a tempering annealing after said cold-rolling.

4. A metal sheet as set forth in claim 3, wherein: said tempering annealing is carried out at a temperature of at least 150° C. for a period of 1 to 6 hours.

5. A metal sheet as set forth in claim 1, wherein: said soaking heat treatment is carried out at a temperature of 350° to 630° C for a period of 1 to 48 hours.

6. A metal sheet as set forth in claim 1, wherein: the reduction ratio during said cold-rolling step is at least 20%.

7. A metal sheet as set forth in claim 6, wherein: the reduction ratio is preferably at least 70%.

8. A metal sheet for use in the formation of fins of a heat exchanger comprising:

means defining tube-penetrating holes formed therein by piercing, burling, ironing and flanging steps, and wherein said metal sheet is an Al slab, comprising at least one member selected from Ti, Zr, Mo, Cr, V, Hf, Ta, W, Nb, Tc and Re capable of peritectic reaction with Al, the amount of said element incorporated within said slab being 0.05 to 0.4% by weight when one element is incorporated therein, and when two or more elements are incorporated therein, the amount of at least one element incorporated therein is 0.05 to 0.4% by weight, and the total amount of said elements being incorporated therein is up to 0.5% by weight, and the Al slab further comprises at least one member selected from the group consisting of up to 0.25% by weight of Cu, up to 0.5% by weight of Mg, up to 0.5% by weight of Mn, up to 0.7% by weight of Fe, up to 0.002% by weight of Be, up to 0.1% by weight of B in the form of $TiB_2$ and up to 0.7% by weight of Si, which has been subjected to a soaking heat treatment, hot rolling, cold rolling, and a tempering annealing, at a temperature of at least 150° C without initiating recrystallization, after said cold-rolling.

9. A metal sheet as set forth in claim 8 wherein the element capable of peritectic reaction with Al is preferably one member selected from Ti, Zr and Mo.

10. A metal sheet as set forth in claim 8 wherein one element capable of peritectic reaction with Al is preferably incorporated in an amount of 0.1 to 0.2% by weight.

11. A metal sheet as set forth in claim 8 wherein the Al slab further comprises 0.5 to 2.0% by weight of Zn.

* * * * *

UNITED STATES PATENT AND TRADEMARK OFFICE

CERTIFICATE OF CORRECTION

PATENT NO. : 4,072,542
DATED : February 7, 1978
INVENTOR(S) : HIROSHI MURAKADO ET AL It is certified that error appears in the above-identified patent and that said Letters Patent are hereby corrected as shown below:

Column 1, line 35, after "as", insert --that--;

Column 3, line 26, delete "if", and insert --is--;

Column 4, line 47, delete "wholely", and insert --wholly--;

Column 7, line 58, delete "XX", and insert --XΔX--;

Column 10, line 56, delete "convenient", and insert --conventional--;

Column 11, line 24, after "of" (first occurrence), insert --the--;

Column 11, line 36, delete "xΔX", and insert --XΔX--;

Column 12, line 46, delete "securd", and insert --secured--;

Column 12, line 57, delete "be", and insert --by--;

Column 12, line 61, delete "weihgt", and insert --weight--;

Column 13, lines 3, 7, 10, 13, 16 and 19, delete "A metal sheet as set forth in", and insert --The process of--;

Signed and Sealed this

*Third* Day of *October 1978*

[SEAL]

*Attest:*

RUTH C. MASON
*Attesting Officer*

DONALD W. BANNER
*Commissioner of Patents and Trademarks*